US012326005B1

(12) United States Patent
Moore

(10) Patent No.: US 12,326,005 B1
(45) Date of Patent: Jun. 10, 2025

(54) LAYERED DISC SYSTEMS FOR POWER TROWELING

(71) Applicant: Mark Clifford Moore, Newport Beach, CA (US)

(72) Inventor: Mark Clifford Moore, Newport Beach, CA (US)

( * ) Notice: Subject to any disclaimer, the term of this patent is extended or adjusted under 35 U.S.C. 154(b) by 0 days.

(21) Appl. No.: 19/046,433

(22) Filed: Feb. 5, 2025

Related U.S. Application Data

(60) Provisional application No. 63/684,381, filed on Aug. 17, 2024, provisional application No. 63/694,010, filed on Sep. 12, 2024.

(51) Int. Cl.
*E04F 21/24* (2006.01)

(52) U.S. Cl.
CPC ..... *E04F 21/245* (2013.01)

(58) Field of Classification Search
CPC ..... E04F 21/245; E04F 21/247; E04F 21/248
See application file for complete search history.

(56) References Cited

U.S. PATENT DOCUMENTS 7,255,513 B2 * 8/2007 Lampley ..... E04F 21/245 404/112
7,731,573 B2 * 6/2010 Rivard ..... B24D 9/003 451/538
8,052,506 B2 * 11/2011 Rivard ..... B24D 13/14 451/538

FOREIGN PATENT DOCUMENTS

DE 19700763 A1 * 7/1998 ..... E04F 21/24

* cited by examiner

*Primary Examiner* — Gary S Hartmann
(74) *Attorney, Agent, or Firm* — CIONCA IP Law P.C.

(57) ABSTRACT

Systems for a layered disc assembly for use with power troweling equipment. The layered assembly having: a flattened circular shape; a foam disc positioned between a first metal disc and a second metal disc; a plurality of channels cut into an outer edge of the foam disc; the first metal disc having a flat top side, and a bottom side having a first type of mount; the second metal disc having a flat bottom side, and a top side having a second type of mount configured to be removably attached to the first type of mount when the first and second types of mounts are inserted into the plurality of channels. The first side and the second side of the layered disc assembly are identical and reversible.

20 Claims, 8 Drawing Sheets

LAYERED DISC SYSTEMS FOR POWER TROWELING

CROSS-REFERENCE TO RELATED APPLICATIONS

This application claims the benefit of U.S. Provisional Application No. 63/684,381, filed Aug. 17, 2024, and U.S. Provisional Application No. 63/694,010, filed Sep. 12, 2024, which are each hereby incorporated by reference, to the extent that they are not conflicting with the present application.

BACKGROUND OF INVENTION

1. Field of the Invention

The invention relates generally to concrete finishing, and more specifically to float pans used in cast-in-place flooring applications.

2. Description of the Related Art

Generally, during the finishing process for concrete, it can be difficult to achieve uniform flatness of the concrete. For example, some pans commonly used in the industry may be convex with a turned-up radius edge around their perimeters, which inherently limits their ability to achieve optimal floor flatness during the concrete finishing process. Without a flat surface, the pan may not be able to produce an extra flat result.

Pans used for concrete finishing can also suffer from premature wear. Conventional methods of achieving flat to very flat concrete floors generally involve the use of power troweling machines, available in both walk-behind and ride-on models. These machines typically utilize circular, convex metal pans attached to finishing blades. These pans, which range in diameter from 36 to 60 inches, are employed shortly after the concrete has been poured and has begun to set.

However, existing systems can be inefficient due to the convex shape of the pans, and the premature wear on these pans that can occur from blade pressure. This results in the need for an improved attachment method for pans that enhances performance during the concrete finishing process.

Therefore, there is a need for a solution to the above problems.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

Provided herein are systems and methods for concrete finishing, and more specifically, to improved systems for float pans used in cast-in-place flooring applications. Provided herein are layered concrete finishing float disc systems to be easily attached to and associated with power troweling systems, which can then be used to for leveling and finishing poured concrete once the layered float disc system is secured to the power troweling equipment. These systems configured for use with power troweling equipment are referred to herein as "layered concrete finishing float disc systems," or "layered float disc systems."

In some embodiments, systems are disclosed having a polyethylene foam disc with metal welded bolt-together discs that conjoin multiple metal pieces in conjunction with a power trowel for enhanced finishing of concrete surfaces. Generally, in such embodiments, the polyethylene foam disc is positioned in between ("sandwiched") a first metal disc and a second metal disc, wherein both the first metal and disc and the second metal disc each comprise mounts for securing the two metal discs together. It should be understood that any suitable method or means for attaching or securing the two metal discs in a removable manner could be used. For example, as disclosed herein, in some embodiments, mounts welded onto each metal disc are provided, wherein the mounts can be screwed or bolted together. In some other embodiments, systems are disclosed having a polyethylene foam disc with integrated magnetic inserts, designed to conjoin metal discs in conjunction a power trowel for enhanced finishing of concrete surfaces.

Generally, the systems provided herein allow for quick and straightforward mounting of power trowels onto a disc assembly, readying the equipment for immediate use. This can improve efficiency of the concrete finishing process.

Generally, the systems provided herein can include reversible metal discs and reusable polyethylene foam cores, which can contribute to a more efficient finishing process, and extended product lifespan.

In some embodiments, the advanced power troweling systems provided herein can include an expanded cross-linked polyethylene foam disc, equipped with welded bolt-together metal discs that secure the metal pieces into one unit. Additionally, neodymium magnetic handles can be used to secure power trowel blades directly to the metal discs. This can allow for easy and secure attachment of the power trowel blades, improving efficiency and reducing setup time. The magnetic handle system can ensure a firm attachment to the power trowel blades, providing a secure fit. This assembly can improve the efficiency and effectiveness of the concrete finishing process by ensuring secure attachment, increase durability, and reduced wear.

Generally, the systems provided herein are sustainable because they allow for extended use even if parts of the system become damaged or are in need of replacement. The layered float disc systems disclosed herein are provided such that they are useful even when such damage occurs. The layered float disc systems are reversible because each metal disc could be used. The layered float disc systems are replaceable because if a metal disc is beyond repair, it could be entirely replaced without the need for replacing the entire system, or replacing parts that are not in need of repair or damaged. The layered float disc systems are reusable because the foam disc can generally still be used and is generally protected from damage and wear and tear. The layered float disc systems are also generally universal and could be used with many different varieties, makes, models, and types of existing or known power troweling systems.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
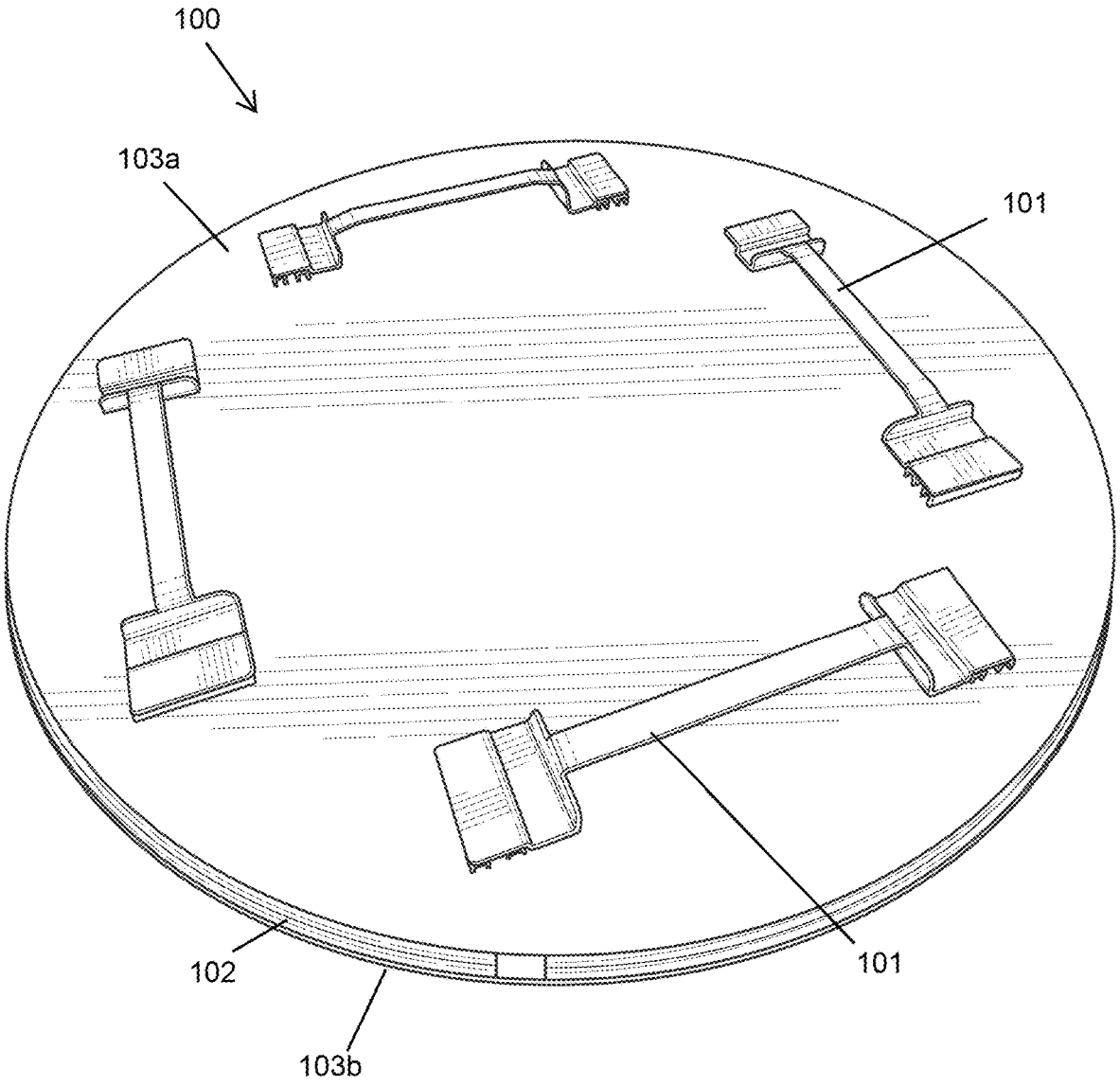
FIG. 1 depicts a top perspective view of a layered float disc system for a power troweling system having a polyethylene foam disc and metal discs, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 105 and 205, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

Provided herein are systems for power troweling for concrete finishing, utilizing a layered float disc system.

FIG. 1 depicts a top perspective view of a layered float disc system 100 for a power troweling system having a polyethylene foam disc 102 and metal discs 103*a* and 103*b*, according to an aspect. Generally, the layered float disc systems provided herein may be used for attaching to a power troweling system, and can directly contact concrete that has been applied and has begun to set. Accordingly, the layered float disc systems provided herein, which directly contact the poured concrete, can be used for leveling and finishing concrete to achieve a uniformly even and flat surface.

In some embodiments, the layered float disc system 100 is comprised of a single polyethylene foam disc 102 positioned between two metal discs 103*a* and 103*b*. The metal discs 103 are shown in further detail in at least FIGS. 5 and 9 herein. Generally, each of the two metal discs may be similar in size and dimensions, and may include similar features, as is described in further detail in FIG. 5. The metal discs may also be generally referred to as element 103 when descriptions apply to both metal discs, for example. The top perspective view of the layered float disc system 100 as depicted in FIG. 1 shows a top side of the layered float disc system 100, wherein the bottom side is not visible. It should be understood that a first metal disc 103*a* is visible in this view and a second metal disc 103*b* is positioned on the underside or bottom side of the layered float disc system.

In some embodiments, the layered float disc system 100 also includes magnetic handles 101. In some embodiments, the layered float disc system 100 includes four magnetic handles. These handles may include neodymium magnets. It should be understood that, since each individual magnetic handle can be associated with the metal disc 103*a* magnetically, each magnetic handle can be moved and adjusted, and the layered float disc system 100 could be adjusted to include five magnetic handles, or however many handles are necessary or desired by a user to fit a power troweling system. Generally, the magnetic handles 101 can be used to secure blades of a power troweling system directly onto one metal disc 103*a* of the layered float disc system 100.

Figure 2:
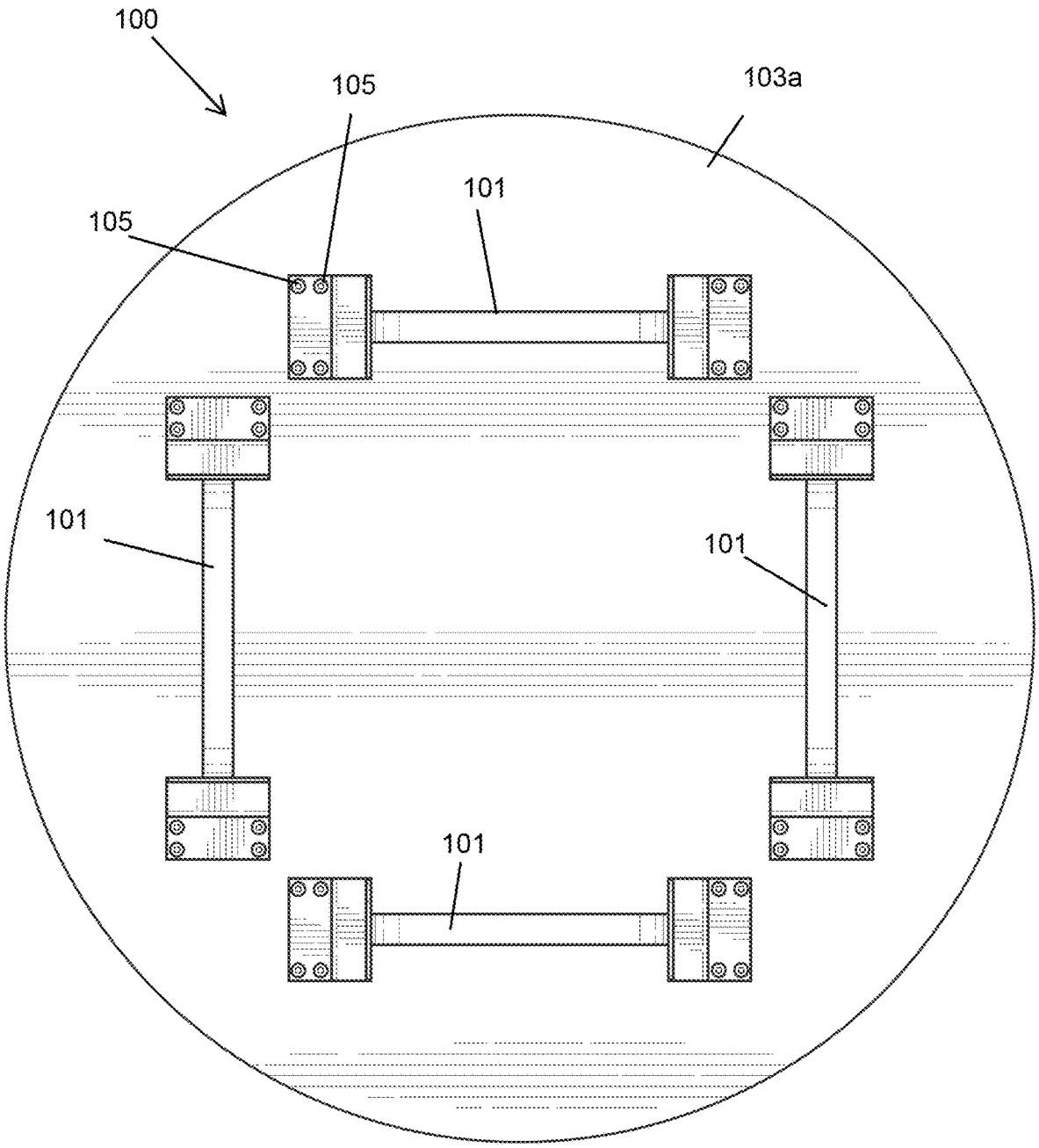
FIG. 2 depicts the top plan view of the layered float disc system for power troweling, according to an aspect.

FIG. 2 depicts the top plan view of the layered float disc system 100 for power troweling, according to an aspect. In some embodiments, the magnetic handles 101 are provided with channel magnets 105 for attaching each handle to one side of the layered float disc system. Each magnetic handle 101 can attach magnetically via the channel magnets to the metal disc 103*a*.

As can be seen in at least FIG. 2, the layered disc assembly created by the layers of a foam disc in between two metal discs is a circular shape. In some embodiments, the layered disc assembly is used for associating with power troweling equipment, and the layered disc assembly is configured to be spun by the equipment for concrete finishing and leveling, for example. Therefore, it may be useful for the layered disc assembly to be provided as a flat circle having 360 degrees. The height of the circle may vary, and may vary depending on the height of each of the components of the layered disc assembly; i.e., the foam disc, and the two metal discs.

Figure 3:
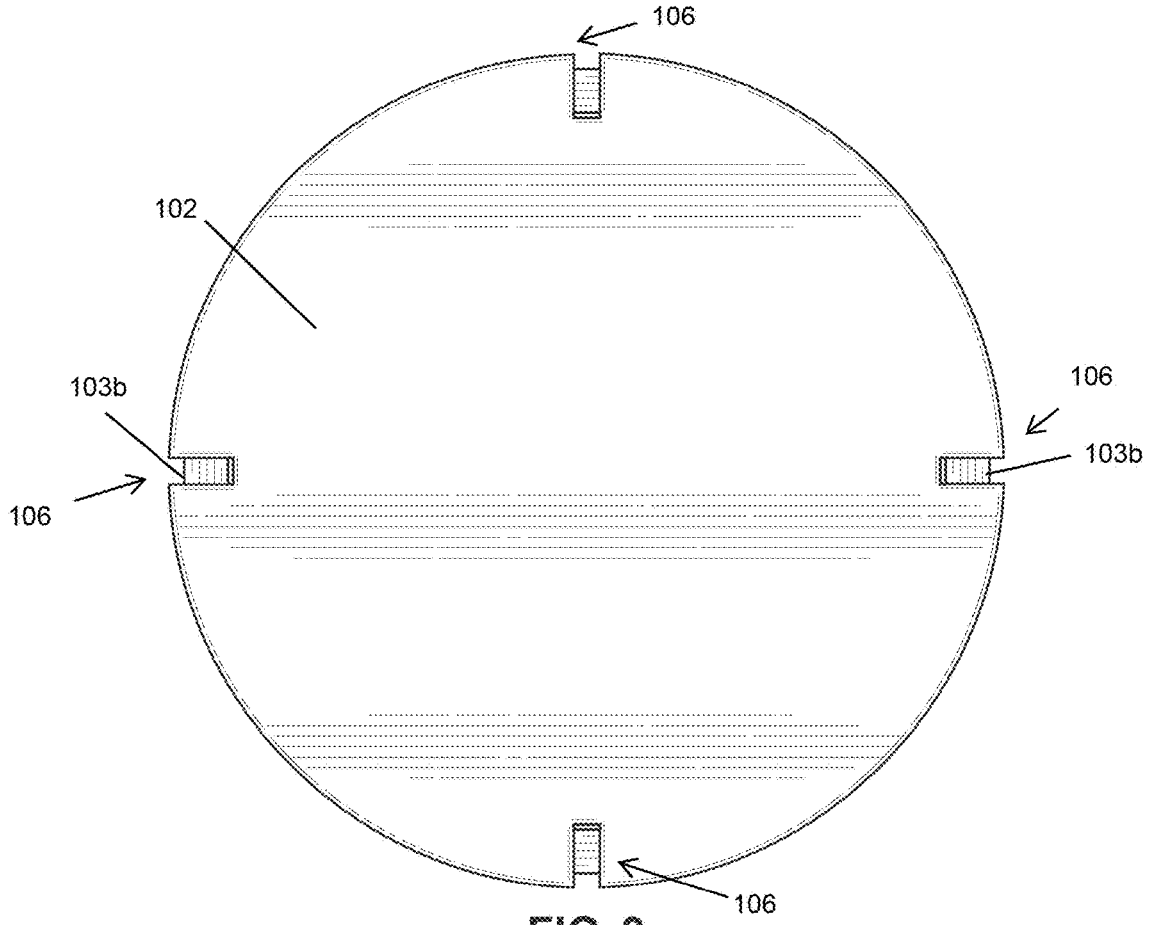
FIGS. 3-4 depict the top plan view and the side perspective view, respectively, of a layered float disc system showing the internal polyethylene foam disc, according to an aspect.
Figure 4:
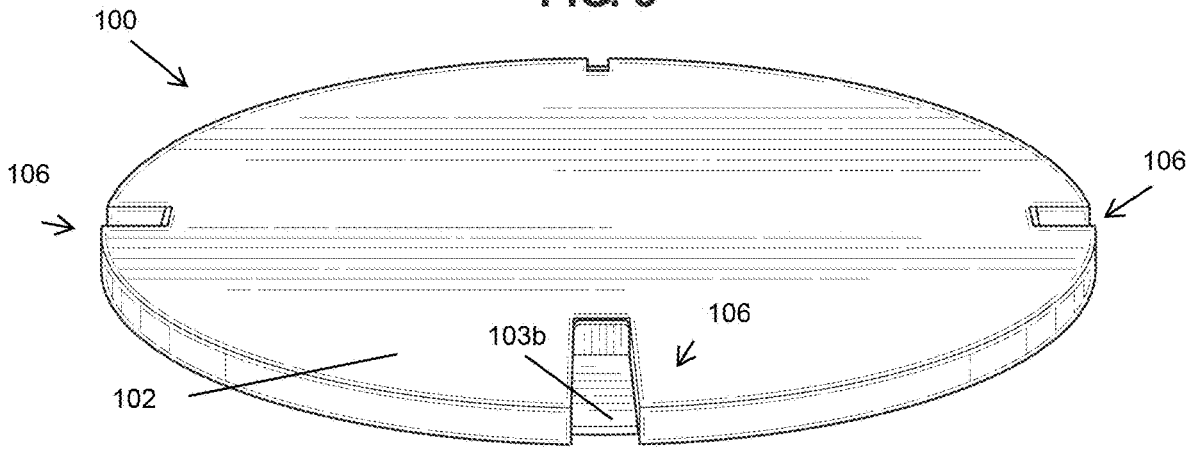

FIGS. 3-4 depict the top plan view and the side perspective view, respectively, of a layered float disc system 100 showing the internal polyethylene foam disc 102, according to an aspect. For visual clarity, the layered float disc system is depicted in FIG. 3 without the top metal disc as shown by 103*a* in FIGS. 1-2, for example. The polyethylene foam disc 102 can be provided with a circular shape, and four channels or cutouts 106 at top, bottom, right, and left (north, south, east, and west) sides of the circular shape. Such channels 106 may be generally rectangular as shown or may have a more rounded shape on the end of the channels that are oriented towards the center point of the circular foam disc. The second metal disc 103*b* that is situated on the bottom side of the layered float disc system can be visible through the cutouts 106.

Figure 5:
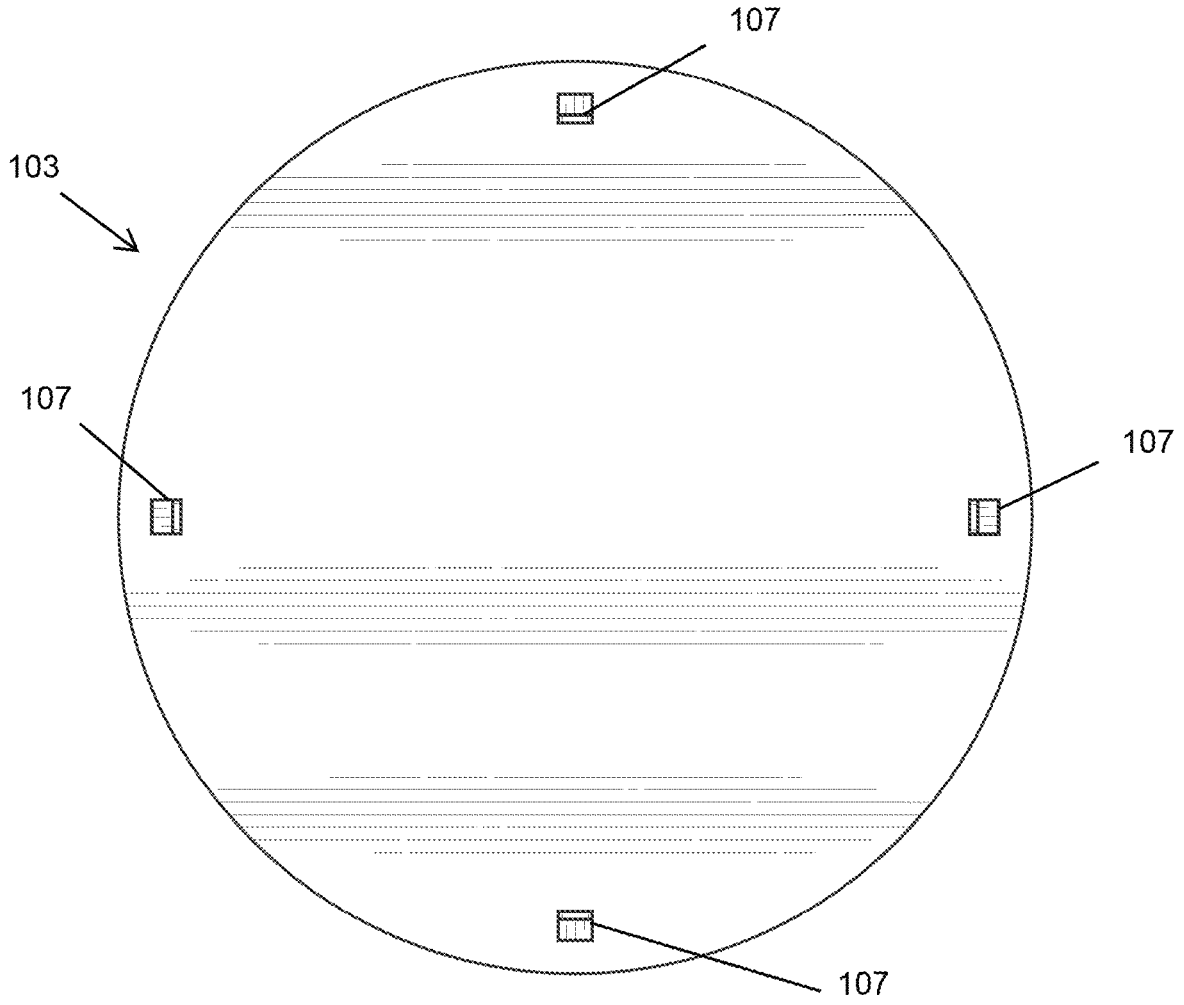
FIG. 5 depicts the bottom view of a metal disc used for a layered float disc system for power troweling systems, according to an aspect.

FIG. 5 depicts the bottom view of a metal disc 103 used for a layered float disc system for power troweling systems, according to an aspect. The metal disc 103 depicted in FIG. 5 may be used for either the top side or the bottom side of the polyethylene foam disc of the layered float disc system. Furthermore, the entire layered float disc system may be reversible, and could be used in either orientation, when fully assembled. Generally, the mounts 107 shown in FIG. 5 are depicted to indicate the positioning and general shape and size of the mounts. However, it should be understood that the mounts provided in the layered float disc system may be of two types. A first type of mount may be associated with a first metal disc, and a second type of mount may be associated with a second metal disc, such that when both metal discs are on either side of a polyethylene foam disc and both metal discs are positioned such that their mounts can be inserted into the foam disc channels, the mounts of the two discs can be associated with each other. Then, the two metal discs can be screwed together. In some embodiments, these elements can be bolted together. Generally, these systems can be referred to as bolt-together systems.

Figure 6:
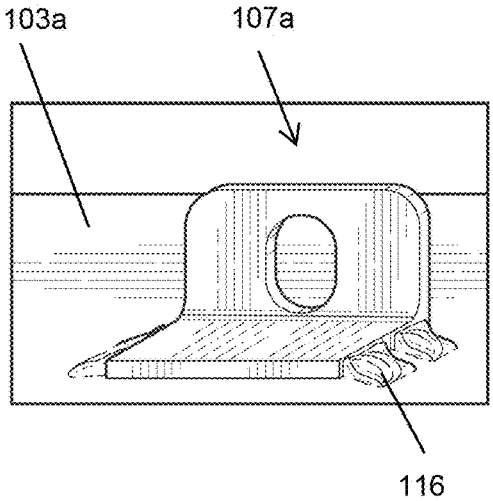
FIGS. 6-7 depict perspective views of a first type of mount, and a second type of mount, respectively, each depicted welded to metal discs, according to an aspect.
Figure 7:
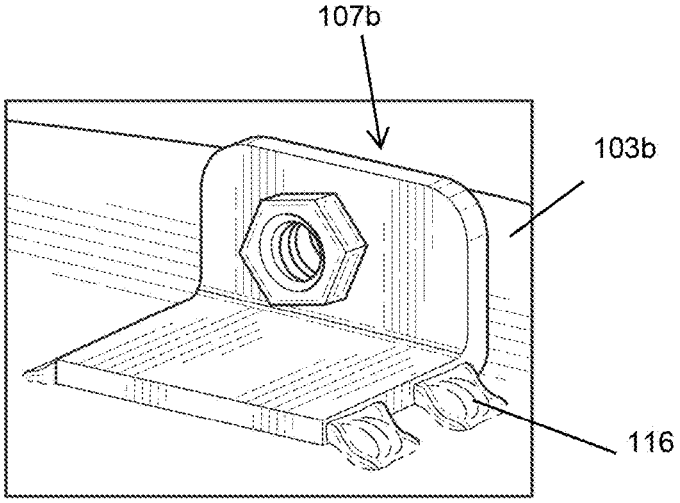

FIGS. 6-7 depict perspective views of a first type of mount 107*a*, and a second type of mount 107*b*, respectively, each depicted welded to metal discs, according to an aspect. As discussed above when referring to FIG. 5, a first metal disc 103*a* may be provided with the first type of mount 107*a*, while a second metal disc 103*b* may be provided with the second type of mount 107*b*. Each mount may be welded onto the metal disc, as represented by welded portions of metal 116, such that the metal disc and the plurality of mounts are a single, integral piece. The bottom view of the metal disc 103 as depicted in FIG. 5 shows four mounts 107 which may correspond to the channels 106 of the polyethylene foam disc 102, as depicted in FIGS. 3-4. That is, when a metal disc 103 is placed underneath or on top of the polyethylene foam disc, each mount 107 may be inserted into a channel 106.

When the polyethylene foam disc is sandwiched by the two metal discs having the two different types of mounts, an insert with a screw, or any other suitable means, could be used for securing the two metal discs together, therefore securing the foam disc in between the two metal discs. Generally, the foam disc may be expanded polyethylene foam rubber. Due to a combination of the expanded polyethylene foam rubber, and the slotted interior tabs of the layered disc assembly, the assembly is provided with a controlled compression effect, which can allow for slight adjustments when pivoting the power troweling equipment during operation. This can allow for more fluid steering. Furthermore, the reversibility of the metal discs, which are uniformly flat, can allow for either side of the assembly to be useful for creating a level, flat concrete surface during the finishing process.

Because the bottom side of each metal disc is provided with mounts with the top side of each metal disc is provided as a uniformly smooth surface, the layered float disc system may be completely reversible when fully assembled.

Figure 8:
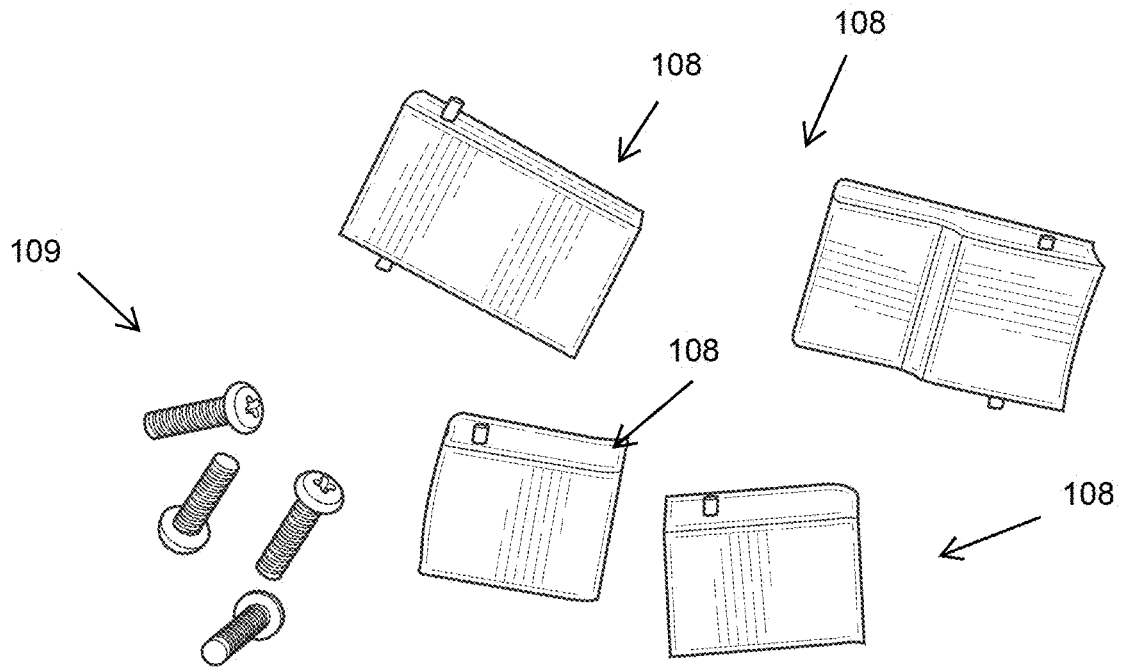
FIG. 8 depicts a plurality of foam caps 108 and screws, according to an aspect.

FIG. 8 depicts a plurality of foam caps 108 and screws 109, according to an aspect. When the assembly of the two metal discs has been performed as discussed above, a foam cap 108 can be inserted into each channel such that there are no holes in the foam disc. Generally, in some embodiments, all channels provided in a foam disc may be the same size and shape, and foam caps 108 of the same size and shape can be used interchangeably in the same foam disc.

Figure 9:
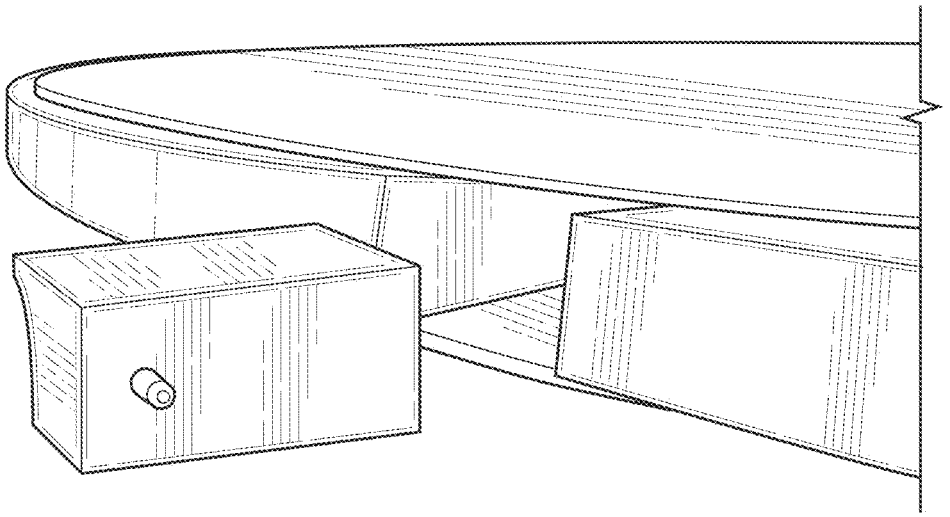
FIG. 9 depicts the side perspective view of a foam cap being inserted into an open channel of a foam disc, according to an aspect.

FIG. 9 depicts the side perspective view of a foam cap 108 being inserted into an open channel of a foam disc, according to an aspect. To complete the assembly of a layered float disc system, the foam caps may be inserted into the channels to protect the mounting together of the two metal discs inside of the channel.

Figure 10:
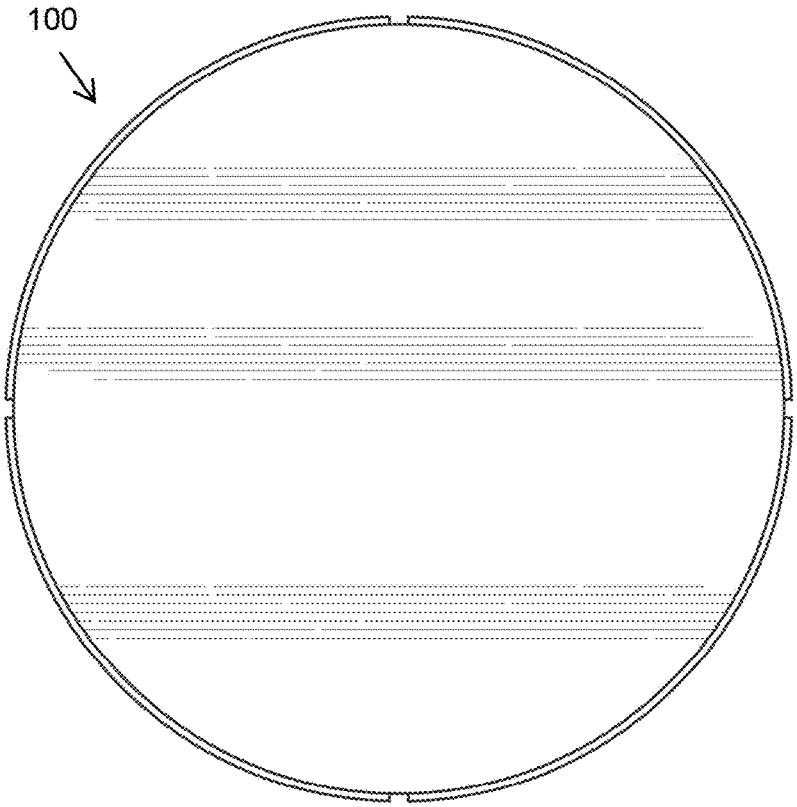
FIG. 10 depicts a top plan view of an assembled layered float disc system 100, according to an aspect.

FIG. 10 depicts a top plan view of an assembled layered float disc system 100, according to an aspect. The magnetic handles as depicted in at least FIG. 1 are not shown in the view depicted in FIG. 10. However, it should be understood that the magnetic handles could be attached magnetically onto the metal disc surface. It should also be understood that, due to the reversible nature of the layered float disc system, the top plan view as depicted in FIG. 10 could also represent a bottom view of the layered float disc system, wherein the magnetic handles are attached on the opposite side and not visible.

Figure 11:
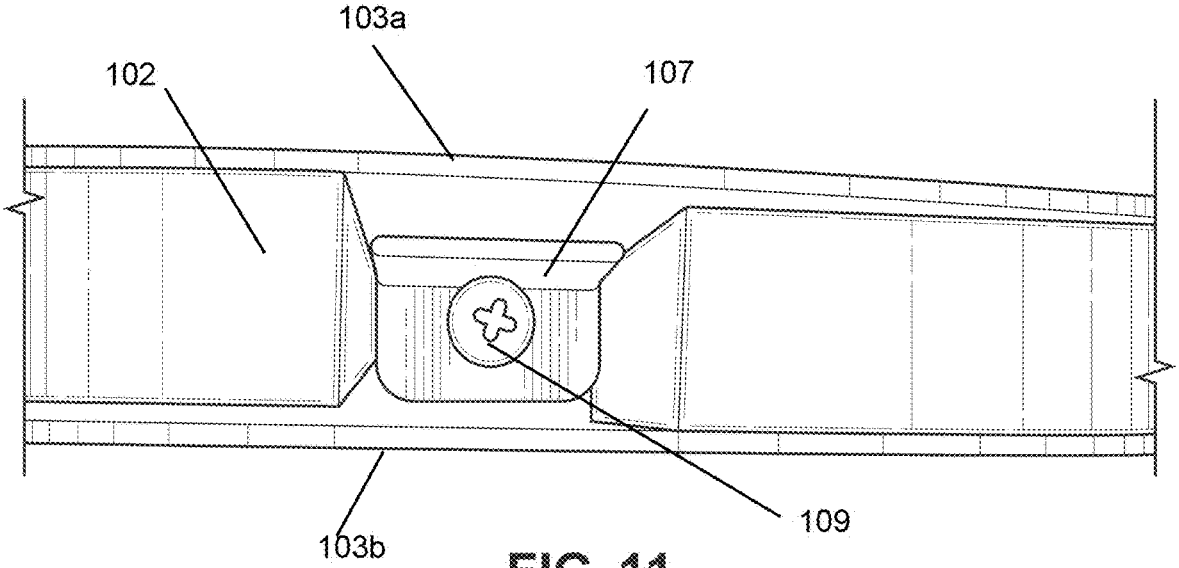
FIG. 11 depicts a partial side elevation view of the interior of a channel of the foam disc of the layered float disc system, according to an aspect.

FIG. 11 depicts a partial side elevation view of the interior of a channel 106 of the foam disc of the layered float disc system, according to an aspect. The foam disc 102 is sandwiched by a top metal disc 103*a*, and a bottom metal disc 103*b*. Without the foam cap yet inserted into the channel, the mounting system can be visible. The screw 109 is used to secure the two metal discs together via the welded-on mount 107.

Figure 12:
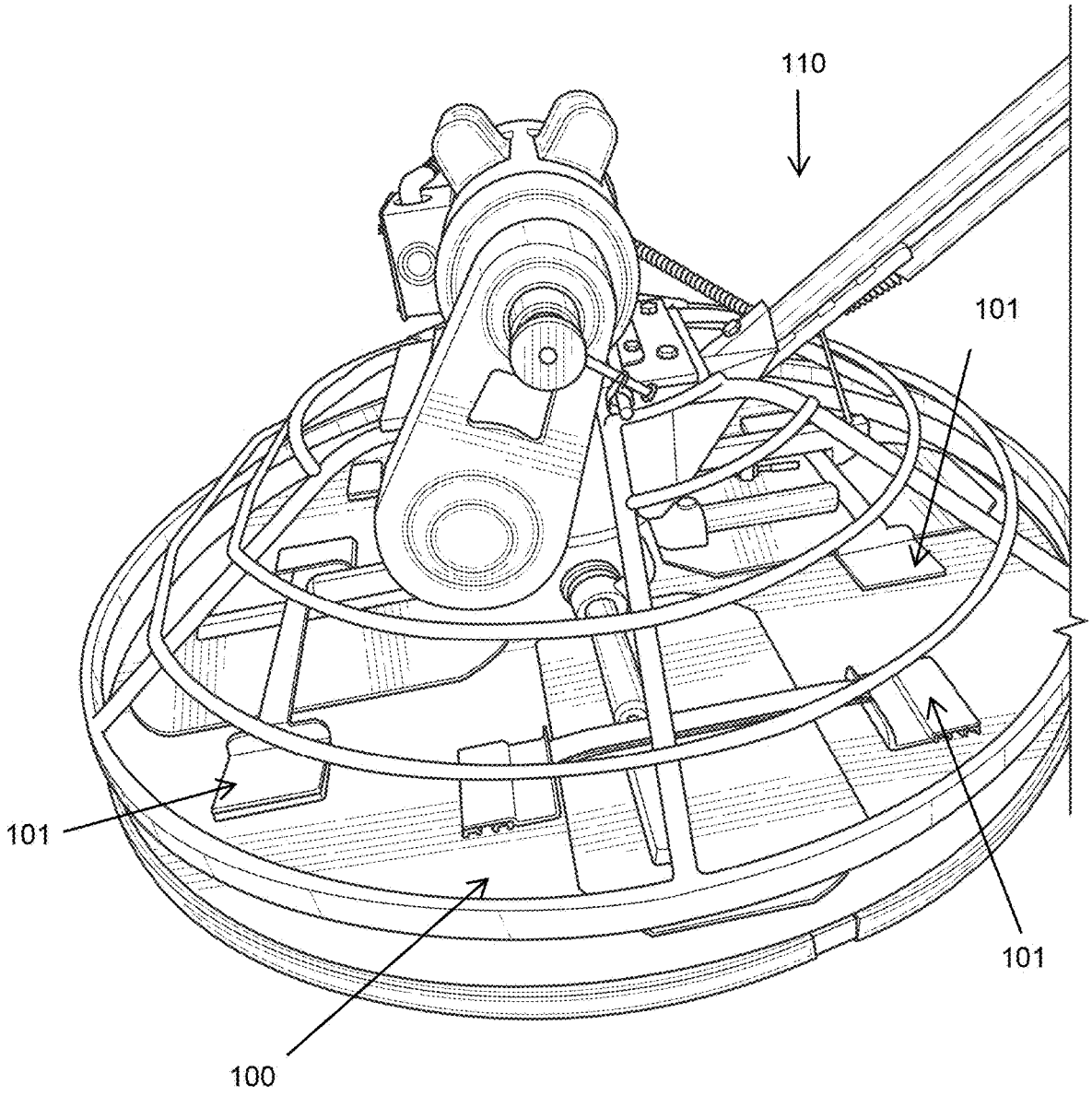
FIG. 12 depicts a side perspective view of a layered float disc system associated with a power troweling system, according to an aspect.

FIG. 12 depicts a side perspective view of a layered float disc system 100 associated with a power troweling system (partially shown) 110, according to an aspect. Generally, any typical power troweling system could be used. Most typical concrete finishing machines can be used with any of the layered floating disc systems disclosed herein. The power troweling system can be associated with the layered float disc system via the magnetic handles. Once the layered float disc system is securely attached, the layered float disc system can be used, as discussed above, for leveling and finishing the poured concrete. As can be seen in FIG. 12, the foam disc is protected by the metal discs and does not make direct contact with the concrete being leveled. After repeated use, the metal discs could become worn through the grinding action of leveling concrete.

The layered float disc systems disclosed herein are provided such that they are useful even when such damage occurs. The layered float disc systems are reversible because each metal disc could be used. The magnetic handles could be removed and reattached onto the opposite system of system such that each metal disc is used for concrete finishing. The layered float disc systems are replaceable because if a metal disc is beyond repair, it could be entirely replaced without the need for replacing the entire system, or replacing parts that are not in need of repair or damaged. The layered float disc systems are reusable because even when the metal discs are in need of repair or need to be replaced, the foam disc can generally still be used and is generally protected from damage and wear and tear. The layered float disc systems are also generally universal and could be used with many different varieties, makes, models, and types of existing or known power troweling systems.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A layered float disc system for concrete finishing power troweling equipment, the layered float disc system comprising:

a layered assembly having a first metal disc, a second metal disc, and a foam disc positioned between the first metal disc and the second metal disc; the layered assembly having a first side and a second side;

a plurality of magnetic handles; and a plurality of foam caps;

the foam disc comprising:

a flat, circular shape;

an outer edge;

a plurality of channels cut into the outer edge;

the first metal disc comprising a uniformly flat top side, and a bottom side comprising a plurality of a first type of mount welded to the bottom side of the first metal disc;

the second metal disc comprising a uniformly flat bottom side, and a top side comprising a plurality of a second type of mount welded to the top side of the second metal disc;

wherein the plurality of the first type of mount and the plurality of the second type of mount are each positioned on the first metal disc and the second metal disc to be inserted into the plurality of channels when the first metal disc is placed on top of the foam disc and when the second metal disc is placed underneath the foam disc;

wherein the first type of mount and the second type of mount are each configured to be associated with and removably bolted to each other within the plurality of channels;

wherein each foam cap of the plurality of foam caps is configured to fit snugly and removably into a channel of the plurality of channels against the inserted first type of mount and the second type of mount, such that installation of the plurality of foam caps into the plurality of channels creates a circular shape;

wherein the first metal disc and the second metal disc, and the foam disc each comprise a flat, circular shape, such that when the foam disc is positioned between the first metal disc and the second metal disc, and when the plurality of foam caps are installed, the layered assembly comprises a smooth outer circumference;

wherein the plurality of magnetic handles is attachable to the first side of the layered assembly and the first side of the layered assembly becomes attachable to the concrete finishing power troweling equipment, such that the second side of the layered assembly is usable for making contact with concrete during a concrete finishing process;

or is attachable to the second side of the layered assembly and the second side of the layered assembly becomes attachable to the concrete finishing power troweling equipment, such that the first side of the layered assembly is usable for making contact with concrete during a concrete finishing process.

2. The layered float disc system of claim 1, wherein the foam disc is constructed from polyethylene foam.

3. The layered float disc system of claim 1, wherein the plurality of magnetic handles comprises neodymium magnets.

4. The layered float disc system of claim 1, wherein plurality of magnetic handles comprise four magnetic handles.

5. The layered float disc system of claim 1, wherein plurality of magnetic handles comprise five magnetic handles.

6. The layered float disc system of claim 1, wherein the plurality of channels comprise four channels.

7. The layered float disc system of claim 1, wherein the layered assembly comprises a circle shape having 360 degrees when the plurality of foam caps is installed within the plurality of channels.

8. A layered float disc system for concrete finishing power troweling equipment, the layered float disc system comprising:

a layered assembly having a first metal disc, a second metal disc, and a foam disc positioned between the first metal disc and the second metal disc; the layered assembly having a first side and a second side;

a plurality of magnetic handles; and the foam disc comprising:

a flat, circular shape;

an outer edge;

a plurality of channels cut into the outer edge;

the first metal disc comprising a uniformly flat top side, and a bottom side comprising a plurality of a first type of mount associated with the bottom side of the first metal disc;

the second metal disc comprising a uniformly flat bottom side, and a top side comprising a plurality of a second type of mount associated with the top side of the second metal disc;

wherein the first type of mount and the second type of mount are each configured to be associated with and removably secured to each other;

wherein the plurality of the first type of mount and the plurality of the second type of mount are each positioned on the first metal disc and the second metal disc to be inserted into the plurality of channels when the first metal disc is placed on top of the foam disc and when the second metal disc is placed underneath the foam disc;

wherein the first metal disc and the second metal disc, and the foam disc each comprise a flat, circular shape, such that when the foam disc is positioned between the first metal disc and the second metal disc, the layered assembly comprises a smooth outer circumference;

wherein the plurality of magnetic handles is attachable to the first side of the layered assembly and the first side of the layered assembly becomes attachable to the concrete finishing power troweling equipment, such that the second side of the layered assembly is usable for making contact with concrete during a concrete finishing process;

or is attachable to the second side of the layered assembly and the second side of the layered assembly becomes attachable to the concrete finishing power troweling equipment, such that the first side of the layered assembly is usable for making contact with concrete during a concrete finishing process.

9. The layered float disc system of claim 8, wherein the foam disc is constructed from polyethylene foam.

10. The layered float disc system of claim 8, wherein the plurality of magnetic handles comprises neodymium magnets.

11. The layered float disc system of claim 8, wherein plurality of magnetic handles comprise four magnetic handles.

12. The layered float disc system of claim 8, wherein plurality of magnetic handles comprise five magnetic handles.

13. The layered float disc system of claim 8, comprising a plurality of foam caps configured to fit into the plurality of channels.

14. The layered float disc system of claim 8, wherein the layered assembly comprises a circle shape having 360 degrees when the plurality of foam caps is installed within the plurality of channels.

15. A layered disc assembly comprising:

a first metal disc;

a second metal disc;

a foam disc positioned between the first metal disc and the second metal disc;

a flattened circular shape having a first side and a second side;

the foam disc comprising:

an outer edge; and a plurality of channels cut into the outer edge;

the first metal disc comprising a uniformly flat top side, and a bottom side comprising a plurality of a first type of mount welded to the bottom side of the first metal disc;

the second metal disc comprising a uniformly flat bottom side, and a top side comprising a plurality of a second type of mount welded to the top side of the second metal disc;

wherein the first type of mount and the second type of mount are each configured to be associated with and removably secured to each other;

wherein the plurality of the first type of mount and the plurality of the second type of mount are each positioned on the first metal disc and the second metal disc to be inserted into the plurality of channels when the first metal disc is placed on top of the foam disc and when the second metal disc is placed underneath the foam disc;

wherein the first metal disc, the second metal disc, and the foam disc each comprise a flat, circular shape, such that when the foam disc is positioned between the first metal disc and the second metal disc, the layered assembly comprises a smooth outer circumference; and wherein the first side and the second side of the layered disc assembly are identical and reversible.

16. The layered disc assembly of claim 15, comprising a plurality of foam caps.

17. The layered disc assembly of claim 16, wherein the flattened circular shape is a circle having 360 degrees when the plurality of foam caps is installed into the plurality of channels.

18. The layered disc assembly of claim 15, comprising a plurality of magnetic handles configured to be removably and magnetically attached to the first side or the second side.

19. The layered disc assembly of claim 18, wherein the plurality of magnetic handles comprises four magnetic handles.

20. The layered disc assembly of claim 18, wherein association of the layered disc assembly with the plurality of magnetic handles allows the layered disc assembly to be secured to a power troweling equipment system.

* * * * *